United States Patent [19]

Tominaga

[11] 4,112,884

[45] Sep. 12, 1978

[54] VALVE LIFTER FOR INTERNAL COMBUSTION ENGINE

[75] Inventor: Akira Tominaga, Susono, Japan

[73] Assignee: Toyota Jidosha Kogyo Kabushiki Kaisha, Toyota, Japan

[21] Appl. No.: 702,291

[22] Filed: Jul. 2, 1976

[30] Foreign Application Priority Data

Mar. 12, 1976 [JP] Japan ..... 51-26047

[51] Int. Cl.[2] ..... F01L 1/14

[52] U.S. Cl. ..... 123/90.48; 123/90.55; 123/90.57; 123/90.16

[58] Field of Search ..... 123/90.12, 90.13, 90.16, 123/90.55, 90.56, 90.57, 90.58, 90.59, 90.48

[56] References Cited

U.S. PATENT DOCUMENTS

| | | | |
|---|---|---|---|
| 2,090,877 | 11/1935 | Small | 123/90.13 |
| 2,484,109 | 10/1949 | Meinecke | 123/90.57 |
| 2,565,681 | 8/1951 | Fleck | 123/90.16 |
| 2,602,434 | 7/1952 | Barnaby | 123/90.12 |
| 2,785,667 | 3/1957 | Miller | 123/90.16 |
| 2,802,460 | 8/1957 | Shirley | 123/90.12 |
| 3,439,662 | 4/1969 | Jones | 123/90.12 |
| 3,742,921 | 7/1973 | Rendine | 123/90.16 |
| 3,786,792 | 1/1974 | Pelizzoni | 123/90.16 |
| 3,817,228 | 6/1974 | Bywater | 123/90.16 |
| 3,978,826 | 9/1976 | Gavrun | 123/90.12 |

FOREIGN PATENT DOCUMENTS

| | | | |
|---|---|---|---|
| 594,121 | 3/1960 | Canada | 123/90.12 |
| 273,579 | 1970 | U.S.S.R. | 123/90.48 |
| 179,119 | 4/1966 | U.S.S.R. | 123/90.16 |

*Primary Examiner*—Charles J. Myhre
*Assistant Examiner*—Jeffrey L. Yates
*Attorney, Agent, or Firm*—Stevens, Davis, Miller & Mosher

[57] ABSTRACT

A hydraulic valve lifter for an internal combustion engine of the type in which a liquid introduced into a confined chamber in the valve lifter is compressed by a plunger so that the pressure of the compressed liquid causes a valve of an intake or exhaust port of the engine to open, is characterized in that an internal mechanism which regulates the time for initiating the compression of the liquid in the confined chamber in response to the change in the running condition of the internal combustion engine is incorporated in the valve lifter for making the valve operating characteristics optimum for the varying running conditions of the engine.

7 Claims, 7 Drawing Figures

VALVE LIFTER FOR INTERNAL COMBUSTION ENGINE

FIELD OF THE INVENTION

The present invention relates to a valve lifter for internal combustion engines. More particularly, the invention relates to a hydraulic valve lifter for an internal combustion engine which can provide optimum lifting quantities and optimum opening-closing timings in intake and exhaust valves of the internal combustion engines (said lifting quantity and said opening-closing timing of a valve are hereinafter referred to as "operation characteristics of a valve" when both are generalized) in conformity with changes in running conditions of an internal combustion engine such as engine rotation speed and load, and can maintain the output performance of the internal combustion engine at a high level over a broad range of the engine rotation speed.

BACKGROUND OF THE INVENTION

In order to maintain the output performance of an internal combustion engine at a high level over a broad range of the rotation speed of the engine and to allow the engine to continuously exert a high output, intake and exhaust valves are required to have such valve operation characteristics that the lifting quantities of the valves are small and the valve opening-closing timing ranges are narrow in a low rotation speed region or low load region of the engine whereas the lifting quantities of the valves are large and the valve opening-closing timing ranges are broad in a high rotation speed region or high load region of the engine. However, according to conventional valve-operating mechanisms, since means for adjusting operation characteristics of valves in conformity with changes in the rotation speed of an engine are not provided at all, intake and exhaust valves are caused to make opening and closing operations always in fixed manners, and therefore, it is difficult to ensure such valve operation capacities as will allow the engine to exert a sufficient output performance over a broad range extending either from the low rotation speed to the high rotation speed or from the low load region to the high load region. In other words, according to the uses and application conditions of an internal combustion engine, the performance is inevitably reduced in either of the high and low rotation speed regions or either of the high and low load regions.

In conventional intake and exhaust valve operating mechanisms, it is known to eliminate variations or changes in the valve operation caused by vibration or abrasion of intake and exhaust valves, by feeding an oil into a valve lifting means (hereinafter referred to as "valve lifter") from an oil pump to actuate the valve lifter to compensate for the variations or changes. More specifically, the clearance in the valve lifter is diminished by the structure in which the valve lifter is operated by utilizing the pressure of the oil, whereby vibrations of intake and exhaust valves are prevented and the clearance in the intake and exhaust valve lifting mechanism formed by abrasion of the intake and exhaust valves is eliminated in the interior of the lifter, thus resulting in rectifying variations in the valve operation.

SUMMARY OF THE INVENTION

An object of the present invention is to provide a valve lifter for internal combustion engines in which the above-mentioned reduction of the performance of the engine inevitably encountered in conventional valve lifting mechanisms can be effectively eliminated while the above structure of the liquid-operated lifter is adopted and the output performance of the engine can be maintained at a high level over a broad engine rotation speed range or broad load range by controlling intake of a fuel-air mixture and exhaust of a combustion gas by adjusting the operation characteristics of valves in conformity with changes of the rotation speed and load in the engine.

In accordance with the present invention, there is provided a valve lifter for an internal combustion engine of the type in which a liquid introduced into a confined liquid chamber in the valve lifter is compressed by the lifting motion of a plunger actuated by a valve cam, and the pressure of the compressed liquid causes a valve located in an intake or exhaust port of the engine to open by way of a push rod and a rocker arm, the valve lifter being characterized in that means for regulating is provided for retarding or advancing the time for initiation of the compression of the liquid by the plunger in response to change in the running conditions of the engine, whereby the operation characteristics of the intake and exhaust valves are made optimum for the running conditions of the internal combustion engine.

The present invention will become more apparent from the ensuing description of an embodiment shown in the accompanying drawings wherein.

DESCRIPTION OF AN EMBODIMENT

Figure 1:
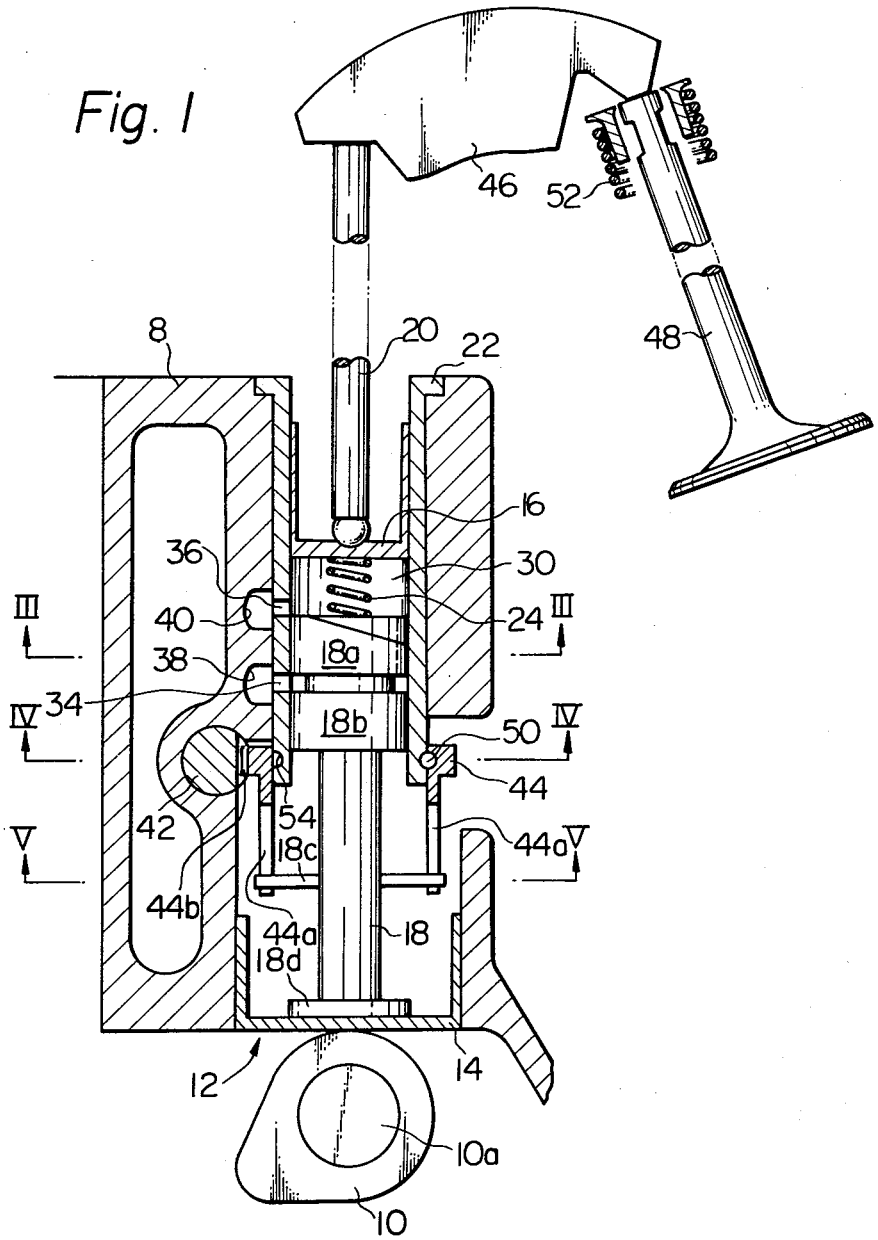
FIG. 1 is a vertical cross-sectional view of a main part of an embodiment of the valve lifter according to the present invention.
Figure 2:
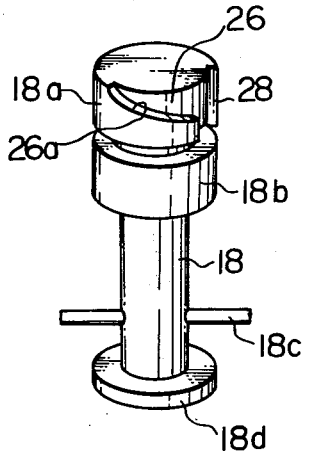
FIG. 2 is a perspective view of a plunger for use in the valve lifter of FIG. 1.

Referring now to FIG. 1, reference numeral 8 denotes a part of the cylinder block of the internal combustion engine. A valve cam 10 is fixed to a cam shaft **10*a* which is rotated and driven at a rotation speed corresponding to a half of the rotation speed of the engine by a crankshaft (not shown) of the engine, and the valve cam 10 is also rotated and driven at a rotation speed corresponding to a half of the rotation speed of the engine. A valve lifter 12 is incorporated into the interior of the cylinder block 8. The lifter 12 comprises a lower lifter ring 14, an upper lifter ring 16, a plunger 18 attached to the lower lifter ring 14 and a sleeve 22 fixed to the cylinder block 8. The lower lifter ring 14 is always contacted and engaged with the valve cam 10, so that it is vertically moved in the interior of the cylinder block 8 by following the rotary movement of the cam 10. When the lower lifter ring 14 is vertically moved, also the plunger 18 fixed to the lower lifter ring 14 through a flange 18*d* vertically slides along the inner wall of the sleeve 22. Referring to FIG. 2, this plunger 18 has the flange 18*d* at the lower end thereof, and in the upper portion of the plunger 18 a first cylindrical piston portion or land 18***a* and a second cylindrical land 18*b* are formed with an annular space interposed therebetween. The upper end surface of the first piston portion or land 18*a* acts as a compression surface of the plunger 18. Cut 26 and vertical groove 28, which have functions described hereinafter are formed in the round peripheral surface of the first land 18*a*, and a peripheral edge portion 26*a* defined by the cut 26 extends so as to spirally rise from the lower end of the first land 18*a* to the upper end thereof. A pin 18*c* described below is inserted in a stem of the plunger 18 and rigidly fixed therein.

Figure 3:
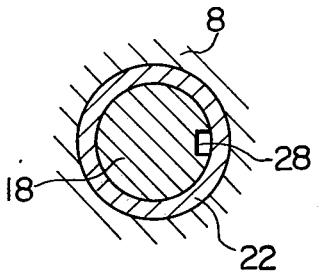
FIGS. 3 through 5 are cross-sectional views taken along the lines III—III, IV—IV and V—V in FIG. 1, respectively.
Figure 4:
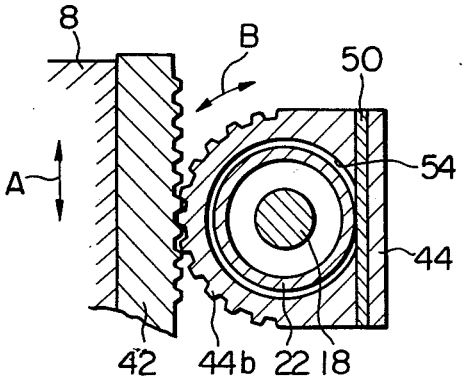
Figure 5:
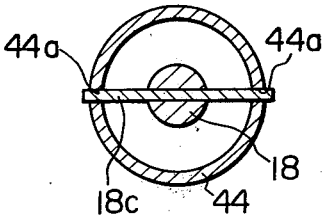

In the embodiment shown in FIG. 1, holes are bored through the side of the sleeve 22 to form ports 34 and 36 for introduction and discharge of a liquid, and liquid chamber 30 is formed between the first land 18*d* of the plunger 18 and the upper lifter ring 16. The upper lifter ring 16 is connected to a push rod 20 through a ball joint and the top end of the push rod 20 is engaged with a rocker arm 46. When this rocker arm 46 is pushed by the push rod 20, as is well-known, it pushes down an intake or exhaust valve 48 so that it opens. Reference numeral 52 denotes a return spring of the valve 48. A spring 24 is built in the liquid chamber 30 and it presses the plunger 18 downwardly and presses the upper lifter ring 16 upwardly, so that clearances between the lower lifter ring 14 and valve cam 10 and between the upper lifter ring 16 and push rod 20 are eliminated and the lower lifter ring 14 and the upper lifter ring 16 are always in contact and engaged with the valve cam 10 and the push rod 20, respectively. The port 34 formed on the sleeve 22 is communicated with a liquid-inlet passage 38 formed in the cylinder block 8, and the port 36 is communicated with a liquid-outlet passage 40 formed in the cylinder block 8. These liquid passages are arranged so that a liquid oil is fed into the liquid-inlet passage 38 by an oil pump (not shown) of the internal combustion engine and the liquid oil is returned to an oil pan (not shown) from the oil-outlet passage 40. More specifically, in the state shown in FIG. 1 where the plunger 18 is lowered down to the lowermost position, the liquid oil incoming from the liquid-inlet passage 38 is led into the annular space between the first and second piston portions or lands 18*a* and 18*b* of the plunger 18 through the port 34 and then flown into the liquid chamber 30 through the vertical groove 28 (FIG. 2). Further, a flow passage of the liquid oil is formed from the liquid chamber 30 to the liquid-outlet passage 40 through the port 36. FIG. 3 clearly illustrates the sectional configuration of the vertical groove 28 formed on the plunger 18. Referring again to FIG. 1, in the valve lifter of the present invention, a rack 42 having rack-teeth is mounted in the cylinder block 8 so that it can slide in the axial direction, and the rack-teeth of the rack 42 are engaged with pinion-teeth 44*b* formed on the top end portion of a rotary ring 44 having a shape resembling that of a hollow cylinder. This rotary ring 44 is attached to the lower end of the sleeve 22. Since a straight pin 50 is inserted into the rotary ring 44 and is also fitted in an annular groove 54 formed at the lower end of the sleeve 22, the rotary ring 44 is allowed to move around the central axis of the sleeve 22 though it is not allowed to move in the vertical direction. Referring to FIG. 4, the pinion-teeth 44*b* of the rotary ring 44 engaged with the rack-teeth of the rack 42 are formed substantially along the semicircle of the rotary ring 44, and it will readily be understood from FIG. 4 that when the rack 42 is moved in the axial direction indicated by an arrow A, the rotary ring 44 receives a rotating force and is rotated in the direction indicated by an arrow B around the sleeve 22 together with the pin 50 while being guided by the annular groove 54. Two long slits 44*a* (FIG. 1) are formed on the rotary ring 44 to face each other, and the pin 18*c* (FIG. 1) of the plunger 18 is fitted in the slits 44*a* (FIG. 1). Therefore, the plunger 18 can be vertically moved while being guided by the slits 44*a* (FIG. 1) of the rotary ring 44. That is, the two long slits 44*a* extend in parallel with the direction in which the plunger 18 vertically moves. While, when the rotary ring 44 is rotated, the plunger 18 is rotated by way of the pin 18*c* (FIG. 1). Incidentally, in the state where the rotary ring 44 is not rotated, since the pin 18*c* (FIG. 1) is fitted in the slits 44*a*, the rotary ring 44 acts as a stop for stopping the rotation of the plunger. FIG. 5 shows the state where the pin 18*c* (FIG. 1) of the plunger 18 is fitted in the slits 44*a* of the rotary ring 44.

Referring again to FIG. 4, in one embodiment, the rack 42 slidably mounted in the cylinder block 8 is connected to a governor mechanism of the engine through a suitable link mechanism (not shown), and when the rotation speed of the engine changes, the rack 42 receives a force of moving in the direction indicated by an arrow A from the governor mechanism through the link mechanism and makes a sliding movement in the interior of the cylinder block 8. When this rack 42 makes a sliding movement, as pointed out hereinbefore, the rotary ring 44 is caused to turn, and in turn, the plunger 18 is rotated. In this manner, the plunger 18 is rotated around the axis thereof according to the change in the rotation speed of the engine. In another embodiment, it is possible to adopt a structure in which the rack 42 is caused to slide in response to the change in the intake manifold vacuum in the internal combustion engine or a structure in which the rack 42 is interconnected with a throttle valve of a carburetor so that the rack 42 is caused to make a sliding movement in response to the change in the opening of the throttle valve. In this embodiment, the plunger 18 is rotated in conformity with the change in the load on the engine.

The operation of the valve lifter of the present invention having the above structure will now be described.

When the cam 10 is rotated in the clockwise direction from the position indicated in FIG. 1, the lower lifter ring 14 and plunger 18 of the lifter 12 begin a lifting movement. Then, the ports 34 and 36 of the sleeve 22 are covered and closed by the first and second lands 18*a* and 18*b* of the plunger 18 and the liquid is confined in the liquid chamber 30. As the plunger 18 further rises under the pressure of the cam 10, the pressure of the liquid in the liquid chamber 30 increases and when this pressure overcomes the force of the valve return spring 52 and the inertia of the push rod 20, the upper lifter ring 16 is lifted up along the sleeve 22 and the push rod 20 is thus lifted up, whereby the valve 48 is opened through the rocker arm 48. As the valve cam 10 is further rotated and the cam lobe passes through the nose point, the plunger 18 starts a descending movement and the force of the return spring 52 comes to surpass the compressive force of the liquid to close the valve 48. At this point, the plunger 18 of the lifter 12 is returned to the lowermost position shown in FIG. 1, the so-called bottom dead center. When the plunger 18 is returned to the bottom dead center, a fresh liquid is supplied into the space between the first and second lands of the plunger 18 from the liquid-inlet passage 38 through the port 34, and this fresh liquid is flown into the liquid chamber 30 through the vertical groove 28 (FIG. 3) of the first land 18*a*. In this embodiment, since supply of the fresh liquid is achieved by feeding a compressed liquid by the oil pump, when the fresh liquid is flown into the liquid chamber 30, the old liquid is pushed out by the fresh liquid and flown into the liquid-outlet passage 40 through the port 36. When the plunger 18 is lifted up under the action of the cam 10, the ports 34 and 36 of the sleeve 22 are first closed and then, the liquid is compressed in the liquid chamber 30. In the present invention, as explained hereinbefore by referring to FIG. 2, since the cut 26 having the spiral peripheral edge 26*a* is formed on the first land 18*a* and the plunger 18 has been rotated around the axis thereof to the position corresponding to the change in the rotating speed of the engine, if the cut 26 of the first land 18*a* having the spiral peripheral edge 26*a* has been located in advance at the assembling stage so as to face the position where the liquid-discharge port 36 (FIG. 1) of the sleeve 22 is disposed, the timing for complete closing of the liquid-discharge port 36 (FIG. 1) can be changed depending on the rotation position occupied by the plunger 18 when the plunger 18 is lifted up by the cam 10 (FIG. 1). More specifically, in the case where a relatively lower portion of the peripheral edge 26*a* faces the liquid-discharge port 36 (FIG. 1), complete closing of the port 36 (FIG. 1) is relatively retarded, and in this case, since compression of the liquid is not initiated in the liquid chamber 30 (FIG. 1) before the port 36 (FIG. 1) is completely closed, the initiation of compression of the liquid is also retarded. On the other hand, in the case where a relatively higher portion of the peripheral edge 26*a* faces the port 36 (FIG. 1), the time of closing of the port 36 (FIG. 1) by the rise of the plunger 18 is advanced and hence, the time of initiation of compression of the liquid is also advanced. When the time of initiation of compression of the liquid caused by the rise of the plunger 18 is retarded or advanced in the liquid chamber 30 (FIG. 1), the lifting quantity of the push rod 20 (FIG. 1) cased by compression of the liquid is changed. More specifically, if the time of initiation of compression of the liquid is retarded, the lifting quantity of the push rod 20 (FIG. 1) is reduced, and if the time of initiation of compression of the liquid is advanced, the lifting quantity of the push rod 20 (FIG. 1) is increased. This lifting quantity of the push rod 20 (FIG. 1) is equal to the lifting quantity of the valve 48 (FIG. 1), namely the opening of the valve 48 (FIG. 1). In other words, in the present embodiment, according to the change in the rotating speed of the engine, the timing for opening and closing of the intake or exhaust valve is regulated so as to change the time period of the opening of the valve and the valve opening or valve lifting quantity is also changed. Of course, if the plunger 18 is rotated in conformity with the change in the load on the internal combustion engine as pointed out, the operation characteristics of intake and exhaust valves can be changed in response to the change in the load on the engine.

Figure 6:
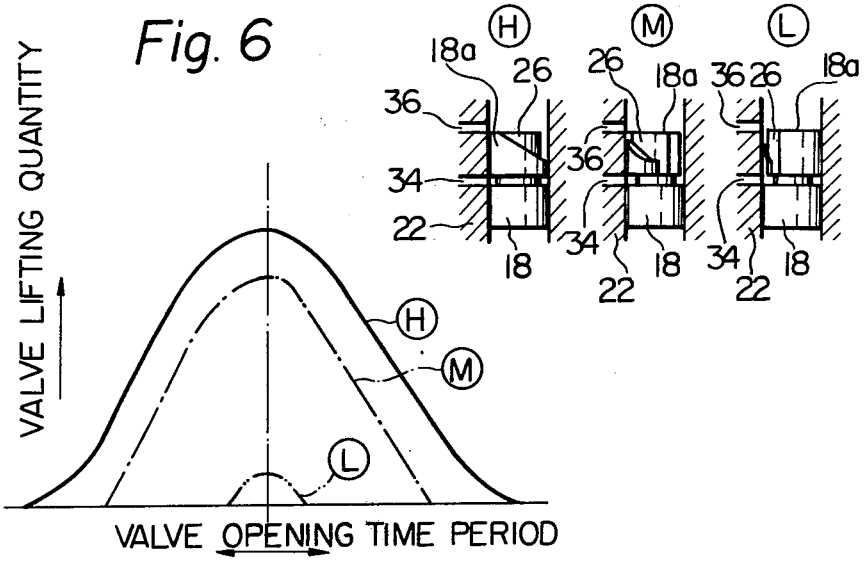
FIG. 6 is a diagram illustrating the operation characteristics of the valve lifter according to the present invention.

FIG. 6 is a diagram illustrating relations of the change of the position facing the liquid-discharge port 36 of the sleeve 22 in the first land 18*a* of the plunger 18 to the valve lifting quantity and the valve opening time period. In FIG. 6, curve H illustrates the case where the cut-free portion of the first land 18*a* faces the port 36 and closing of the port 36 is initiated immediately when the rising movement of the plunger 18 is started; curve M illustrates the case where a relatively upper portion of the peripheral edge 26*a* of the first land 18*a* faces the port 36; and curve L illustrates the case where a relatively lower portion of the peripheral edge 26*a* of the first land 18*a* faces the port 36. In order to obtain optimum valve operation characteristics in response to the change in the rotating speed of the engine or the load on the engine, the operation characteristics of valves are actually measured and determined with respect to respective rotation speeds of the engine or respective loads on the engine and the valve lifting means is assembled based on results of this measurement. Namely, the valve lifting means is assembled by adjusting the positional relationships between the rotary ring 44 of the lifter 12 and the rack 42 and between the rotary ring 44 and the cut 26 of the plunger 18 so as to make the time of initiation of compression of the liquid optimum to the rotation speed of the engine or the load on the engine.

In the case where an engine brake acts on the engine, if it is arranged so that the vertical groove 28 of the first land 18*a* of the plunger 18 faces the port 36 of the sleeve 22, when the engine brake is actuated, the liquid is not compressed in the liquid chamber 30 of the lifter 12 and hence, the lifting quantity is reduced to zero. Accordingly, the intake or exhaust valve is not opened and emission of a pollutant-containing exhaust gas from the engine is prevented. This is a subsidiary effect attained by the present invention.

Figure 7:
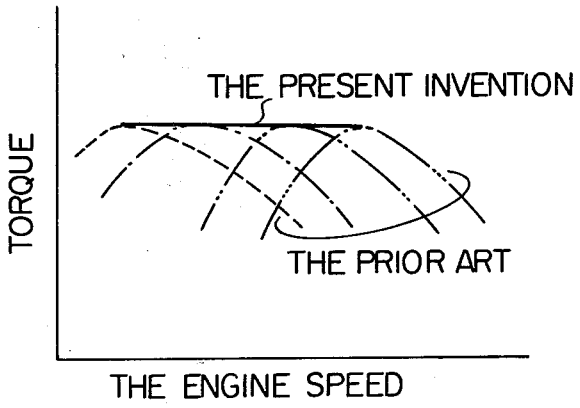
FIG. 7 is another diagram illustrating the comparison of the output performance of an internal combustion engine provided with the valve lifter of the present invention with that of an internal combustion engine provided with a valve lifter of the prior art.

FIG. 7 is a diagram in which the output performance of an internal combustion engine equipped with the valve lifting means is compared with the output performance of an internal combustion engine equipped with a conventional valve lifting mechanism, based on results of the measurement of the output torque of the engine at various rotation speeds of the engine. From FIG. 7, it is seen that in case of an internal combustion engine equipped with the conventional valve lifting mechanism, the output torque is highest only at one point in the rotation speed range and the output torque is reduced at other points in the rotation speed range to cause reduction of the output performance of the engine. On the other hand, in case of an internal combustion engine provided with the valve lifting means of the present invention, the output torque can be maintained at a high level throughout the broad rotation speed range.

From the foregoing, it will readily be understood that according to the present invention, the operation characteristics of intake and exhaust valves can be made optimum in conformity with the change in the rotation speed of or the load of an internal combustion engine and the output performance of the engine can be enhanced by performing intake and exhaust operations in the internal combustion engine under optimum conditions.

What is claimed is:

1. A valve lifter adapted for actuating a valve positioned in either intake or exhaust port formed in a cylinder of an internal combustion engine comprising:

a hollow sleeve fixedly mounted in a head portion of said engine cylinder, the sleeve having therein a cylindrical inner wall;

a round lifter element slidably fitted in said hollow sleeve;

a push rod connected to said round lifter element;

a rocker arm co-operable with said push rod for opening the valve;

a plunger arranged to be movable into and away from said hollow sleeve and to be also angularly movable about the axis thereof, said plunger including a first and a second cylindrical lands both arranged to be slidable along the cylindrical inner wall of said hollow sleeve, said first and second cylindrical lands defining therebetween an annular space;

a liquid chamber defined between said round lifter element and said first cylindrical land of said plunger;

a liquid-introduction port formed in said inner wall of said sleeve and fluidly connectable to said annular space;

a liquid-discharge port formed in said inner wall of said sleeve and fluidly connectable to said liquid chamber;

a liquid-inlet passageway formed in said engine cylinder head so as to be connected to said liquid-introduction port;

a liquid-outlet passageway formed in said engine cylinder head so as to be connected to said liquid-discharge port;

a liquid passageway means fluidly connecting between said annular space and said liquid chamber;

a valve cam driven by said engine for causing the axial movement of said plunger into and away from said hollow sleeve, and;

means for providing said plunger with the angular movement in response to the change in the operation condition of said internal combustion engine, said first land being provided with an end surface for compressing a liquid in said liquid chamber in response to the movement of said plunger into said hollow sleeve, and a circumferential surface for facing and covering said liquid-discharge port in response to the movement of said plunger into said hollow sleeve, said circumferential surface of said first land being formed with a cut defining a spirally extending edge co-operable with said liquid-discharge port so that the time for initiating the compression of the liquid in said liquid chamber by said compression end surface of said first land is varied in response to the angular movement of said plunger.

2. A valve lifter as set forth in claim 1, wherein said second cylindrical land of said plunger covers said liquid-introduction port in response to the movement of said plunger into said hollow sleeve.

3. A valve lifter as set forth in claim 1, further comprises a spring received in said liquid chamber for ensuring the connection between said round lifter element and said push rod, said spring in said liquid chamber further pressing said plunger for ensuring the engagement of said plunger with said valve cam.

4. A valve lifter as set forth in claim 1, wherein said angular movement providing means comprises:

a ring element rotatably supported on said hollow sleeve, said ring element being provided with pinion-teeth formed at a peripheral portion thereof and at least a slit formed therein so as to be extended in parallel with the direction of the movement of said plunger into and away from said hollow sleeve;

a rack element slidably mounted in said engine cylinder head so that it is displaced in response to the change in the running condition of said engine, said rack element being provided with rack-teeth engaging said pinion-teeth of said ring element, and;

a pin projecting from said plunger into said slit of said ring element.

5. A valve lifter for an internal combustion engine comprising a cam, a valve, means normally biasing said valve to closed position, a rocker for acting on said valve to open the same against said biasing means, a cylinder, a piston in said cylinder for acting on said rocker, a plunger in said cylinder comprised of two spaced apart piston members, said plunger being mounted for reciprocation in said cylinder in response to the action of said cam, said first piston member defining with said piston a fluid space therebetween, a fluid reservoir, a port in said cylinder establishing communication between said reservoir and said fluid space, the path of reciprocation of said first piston member being such as to cover said port, a groove in the sidewall of said first piston member having a spiral defining edge, means to vary the angular position of said plunger in response to an operating condition of the engine whereby to vary the stroke which said first piston member travels before cutting off flow from said fluid space through said port to said reservoir, a second port leading from said cylinder to said reservoir, said second port being so situated that the second piston member of said plunger introduces liquid into said fluid space when the compression of said liquid in said fluid space by said end surface of said first piston member is initiated.

6. A valve lifter as set forth in claim 5, wherein said port is fluidly connectable to said fluid space by way of a space defined between said first and second piston members of said plunger and a vertical groove formed in said first piston member.

7. A valve lifter for an internal combustion engine comprising a cam, a valve, means normally biasing said valve to closed position, a rocker for acting on said valve to open the same against said biasing means, a cylinder, a piston in said cylinder for acting on said rocker, a plunger in said cylinder comprised of two spaced apart piston members, said plunger being mounted for reciprocation in said cylinder in response to the action of said cam, said first piston member defining with said piston a fluid space therebetween, a fluid reservoir, a port in said cylinder establishing communication between said reservoir and said fluid space, the path of reciprocation of said first piston member being such as to cover said port, a groove in the sidewall of said first piston member having a spiral defining edge, means to vary the angular position of said plunger in response to an operating condition of the engine whereby to vary the stroke which said first piston member travels before cutting off flow from said fluid space through said port to said reservoir, said angular position varying means comprising a ring element rotatably engaged with said plunger and formed with pinion-teeth at a portion thereof, and a rack element formed with rack-teeth engaging with said pinion-teeth of said ring element, said rack element being arranged to be displaced in response to the change in said running condition of said engine, said rotatable ring element includes at least a slit formed to be extended in parallel with the direction of said lifting motion of said plunger, and wherein said plunger has a pin projecting therefrom into said slit of said rotatable ring element.

* * * * *